US008215858B2

(12) United States Patent
Carroll et al.

(10) Patent No.: US 8,215,858 B2
(45) Date of Patent: Jul. 10, 2012

(54) TOGGLING COSMETIC LACQUER DISPENSER AND DELIVERY

(76) Inventors: Craig Carroll, Newport Beach, CA (US); Steve Armstrong, San Juan Capistrano, CA (US)

( * ) Notice: Subject to any disclaimer, the term of this patent is extended or adjusted under 35 U.S.C. 154(b) by 431 days.

(21) Appl. No.: 12/390,397

(22) Filed: Feb. 20, 2009

(65) Prior Publication Data

US 2009/0238632 A1 Sep. 24, 2009

Related U.S. Application Data

(63) Continuation-in-part of application No. 12/052,496, filed on Mar. 20, 2008.

(51) Int. Cl.
*B43K 7/12* (2006.01)
*B43K 5/06* (2006.01)

(52) U.S. Cl. ..... 401/115; 401/176; 401/272

(58) Field of Classification Search ..... 401/101, 401/115, 117, 138, 269, 270, 272, 275, 116, 401/129, 176, 274, 277, 280; 215/316, 320
See application file for complete search history.

(56) References Cited

U.S. PATENT DOCUMENTS

| | | | | |
|---|---|---|---|---|
| 2,611,915 | A * | 9/1952 | Prokop et al. | 401/116 |
| 2,932,046 | A * | 4/1960 | Skolnikoff | 401/115 |
| 2,944,274 | A * | 7/1960 | Hopkins | 401/102 |
| 3,035,299 | A * | 5/1962 | Gordon et al. | 401/107 |
| 4,029,422 | A | 6/1977 | Pillsbury | |
| 4,902,152 | A * | 2/1990 | Seidler | 401/117 |
| 4,911,571 | A * | 3/1990 | Inoue et al. | 401/202 |
| 4,991,749 | A | 2/1991 | Kay | |
| 5,397,195 | A * | 3/1995 | Goncalves | 401/277 |
| 5,678,941 | A * | 10/1997 | Nakajima | 401/205 |
| 5,722,436 | A | 3/1998 | Vandromme et al. | |
| 5,735,623 | A | 4/1998 | Gueret | |
| 6,056,470 | A * | 5/2000 | Nehashi et al. | 401/279 |
| 6,082,918 | A | 7/2000 | Gueret | |
| 6,386,781 | B1 * | 5/2002 | Gueret | 401/198 |
| 6,764,239 | B2 * | 7/2004 | Kim | 401/108 |
| 7,168,435 | B2 | 1/2007 | Vieu | |
| 7,293,931 | B2 * | 11/2007 | Lee et al. | 401/269 |
| 7,461,988 | B2 * | 12/2008 | Albisetti | 401/116 |
| 7,597,497 | B2 * | 10/2009 | Levine | 401/202 |
| 2004/0184865 | A1 | 9/2004 | Carroll | |
| 2007/0141862 | A1 | 6/2007 | Gueret | |

FOREIGN PATENT DOCUMENTS

WO PCT/US2008/074959 11/2008
WO PCT/US2010/025152 5/2010

OTHER PUBLICATIONS

U.S. Appl. No. 12/056,492, filed Aug. 25, 2009, Carroll.
U.S. Appl. No. 12/056,492, filed Apr. 29, 2010, Carroll.

* cited by examiner

*Primary Examiner* — David J. Walczak
*Assistant Examiner* — Jennifer C Chiang
(74) *Attorney, Agent, or Firm* — John K. Buche; Buche & Associates, P.C.

(57) ABSTRACT

A toggling dispenser is disclosed with a reservoir capable of containing substances and an integrally placed applicator which, at the user's election, enters and exits the dispenser by shifting or shaking the dispenser. While inside the dispenser, an amount of contained substance collects on the applicator so that when the applicator exits the enclosure, the collected substance may be delivered to a target via contact with the applicator.

4 Claims, 10 Drawing Sheets

TOGGLING COSMETIC LACQUER DISPENSER AND DELIVERY

CROSS-REFERENCE TO RELATED APPLICATIONS

The present application is a Continuation-In-Part of U.S. patent application Ser. No. 12/052,496 entitled "Toggling Cosmetic Lacquer Dispenser & Delivery," filed Mar. 27, 2008.

STATEMENT REGARDING FEDERALLY SPONSORED RESEARCH OR DEVELOPMENT

Not applicable.

BACKGROUND OF THE INVENTION

1. Field of Invention

The present application is in the field of apparatuses for dispensing cosmetic lacquers. Specifically, the present application is in the field of apparatuses for dispensing and applying cosmetic lacquer to finger and toe nails. More specifically, the present application is an all-in-one delivery apparatus that facilitates application of finger and toe nail polish, and the like (e.g., the applicator and lacquer reservoir are integrally associated as a single unit).

2. Background of the Invention

Typically, cosmetic lacquers are stored in small glass or plastic bottles. The caps to these typical embodiments have an applicator brush which attaches to and extends from the inner surface of the cap. When the user of these typical embodiments wishes to apply the lacquer, the user must use two hands—one to hold the bottle and one to apply the lacquer using the cap/brush applicator. A user may attempt to apply the lacquer single-handedly by placing the bottle of lacquer on a table or other surface, thereby eliminating the need for a second hand. However, such a practice leaves the bottle susceptible to tipping over when the user re-inserts the cap/brush applicator into the bottle to gather additional lacquer on the applicator or when that user seeks to place the cap back on the bottle. A further limitation of the typical embodiment is that, since the brush-applicator is limited in its reach by its attachment to the cap, the brush-applicator is incapable of reaching all of the inner surfaces of the reservoir bottle where usable lacquer may remain.

There have been numerous attempts to resolve the various problems described above, as well as others, yet so far, each proposed solution has proven inadequate. For instance, one such design features an applicator which is isolated from the lacquer reservoir during periods of non-use, rather than submerged therein like the typical embodiments. This results in the brush drying out and becoming unusably brittle and stiff. Others employ a disposable dispenser for "one-time" use, which results in excessive waste and additional costs for the user. The limitations of these designs are obvious.

SUMMARY OF THE INVENTION

Accordingly, it is an object of the present invention to provide a toggling cosmetic lacquer dispenser, which incorporates the lacquer or other desired fluid substance reservoir and fluid substance applicator into a single unit.

It is another object of the present invention to provide a toggling cosmetic lacquer dispenser which maximizes the use of fluid substance remaining in the fluid substance reservoir.

It is yet another object of the present invention to provide a toggling cosmetic lacquer dispenser which employs a shut-off function to minimize spillage of the fluid substance stored in the reservoir, even when the dispenser is inadvertently tipped over.

A further object of the present invention is to provide a toggling cosmetic lacquer dispenser which saturates the applicator in the fluid substance stored in the reservoir cavity during storage, thus preventing the drying out of the applicator and allowing applicator reusability.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures in which:

FIG. 15 also represents an inventory of components used for assembly of one possible embodiment of the dispenser 1.

Figure 1:
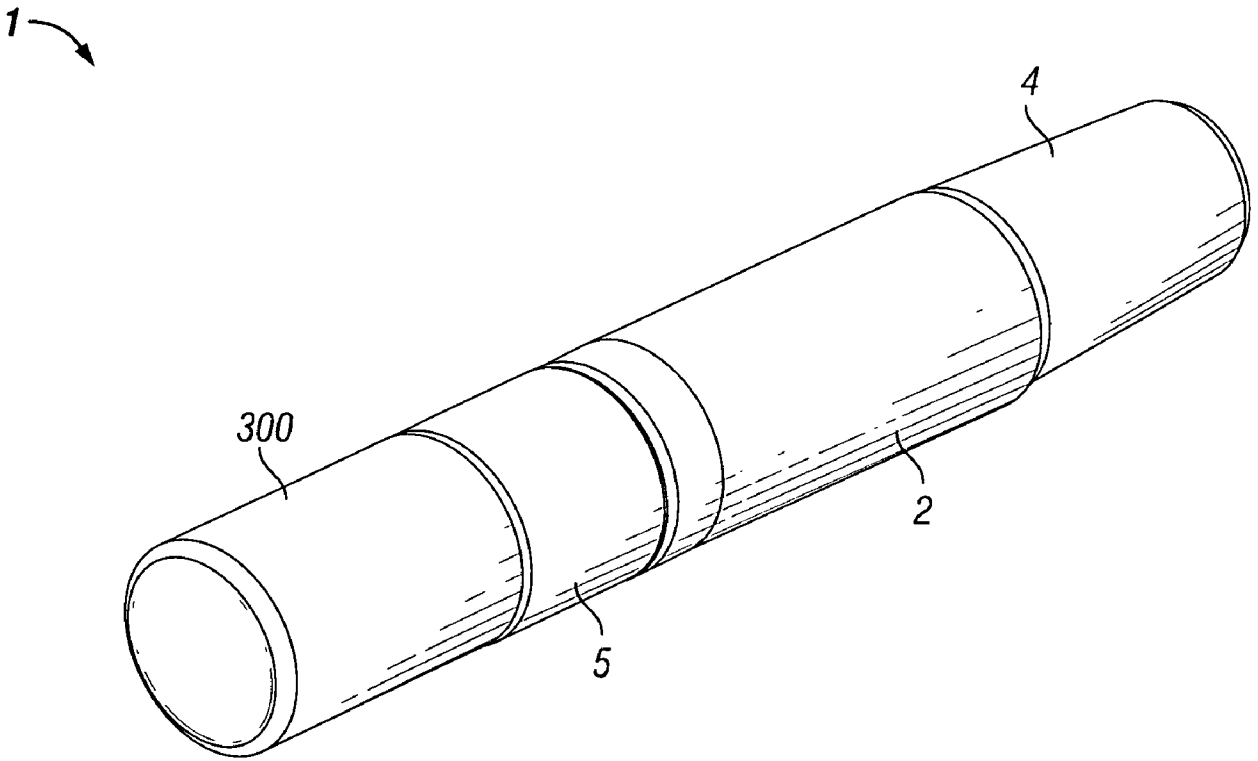
FIG. 1 is a perspective view of a dispenser 1 in a closed configuration.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

The dispenser 1 of the present application generally has a reservoir cavity 20 capable of holding fluid substances and an integrally placed applicator 7 operationally configured to enter and exit a reservoir cavity 20. While inside the reservoir cavity 20, the fluid substance stored therein suitably collects on the applicator 7 in a desirable amount. The applicator 7 then may be extended outside the reservoir cavity 20, and the fluid substance collected upon the applicator 7 may then be delivered to a target via contact with the applicator 7. This process may then be repeated until the fluid substance stored within the reservoir cavity 20 has been completely depleted. The more specific elements of the dispenser 1 are depicted in the drawings.

FIG. 1 depicts the dispenser 1 in a closed configuration. The reservoir 2 and head 5 form an enclosure capable of holding fluid substances. At one end of the reservoir 2 is the tail cap 4, and at the opposite end of the reservoir 2 is the head 5. The defining feature of a closed configuration is a cap 300 positioned over the distal portion of the head 5.

The reservoir 2 is often made of a transparent material that is also capable of forming a leak-proof seal, but such is not a requirement. However, the materials suitable for forming the reservoir 2 will vary depending on the physical properties of the substance stored therein, and the exact nature of the dispenser 1 use. For instance, transparency of the reservoir 2 is ideal in the cosmetics field because a user may readily ascertain the qualities of the substance contained therein, such as color and remaining volume, and a sealed container prevents unwanted spillage. Keeping that in mind, the reservoir 2 may be formed using a variety of preferable materials, including but not limited to metals, glasses, alloys, composites, woods, and a variety of hard plastics including but not limited to high-density polyethylene, polypropylenes, PVC, and other materials that will be appreciated by those skilled in the art.

Figure 2:
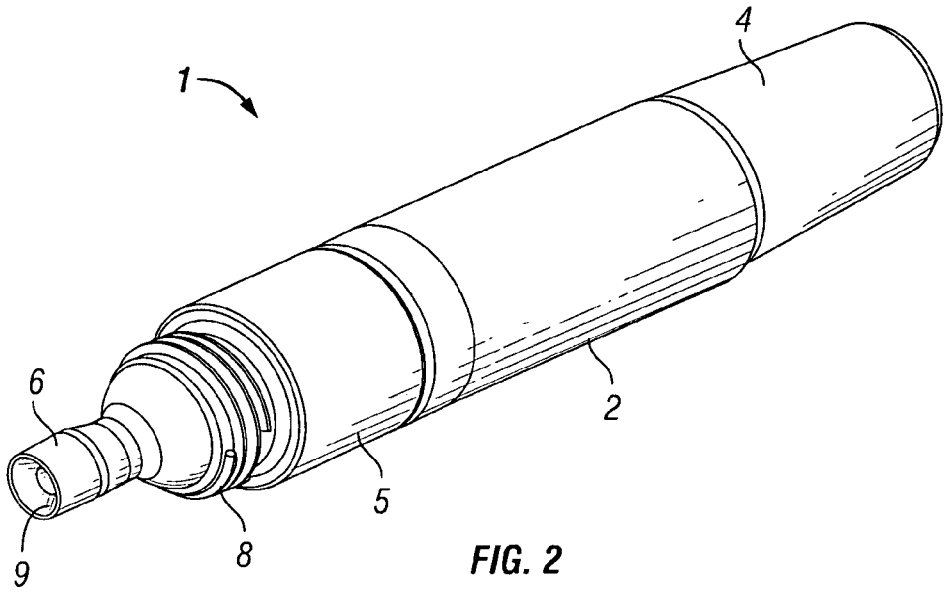
FIG. 2 is a perspective view of a dispenser 1 in an open configuration, with the cap 300 removed to expose the nose 6, and with an applicator 7 retracted into the dispenser 1.

FIG. 2 depicts the dispenser 1 in an open configuration. The open configuration of FIG. 2 is similar to the closed configuration of FIG. 1, except that cap 300 has been removed from the distal portion of the head 5 to expose the nose 6. The nose 6 features an avenue 9 whereby the applicator 7 enters and exits the head 5 when the user tilts the dispenser 1 either vertically up or down, respectively. As illustrated, FIG. 2 depicts the applicator 7 in a retracted position.

Figure 3:
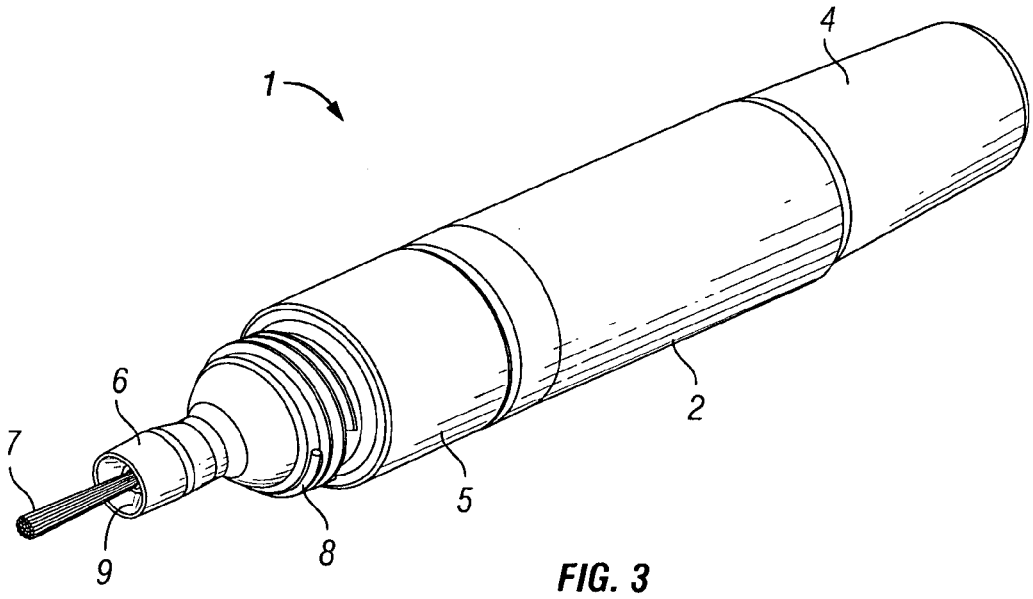
FIG. 3 is a perspective view of a dispenser 1 in a delivery configuration, with the cap 300 removed to expose the nose 6, the nose 6 having an applicator 7 extending distally therefrom.

FIG. 3 depicts the dispenser 1 in a delivery configuration, in which the applicator 7 is extended and ready for use. The delivery configuration of FIG. 3 is similar to the open configuration of FIG. 2, except that the applicator 7 in FIG. 3 is shown extended out of the nose 6 through the avenue 9. As explained in more detail below, in this delivery configuration the fluid substance stored within the reservoir 2, and which previously collected on the applicator 7, may be delivered to a target via contact with the applicator 7 once it is extended.

Figure 4:
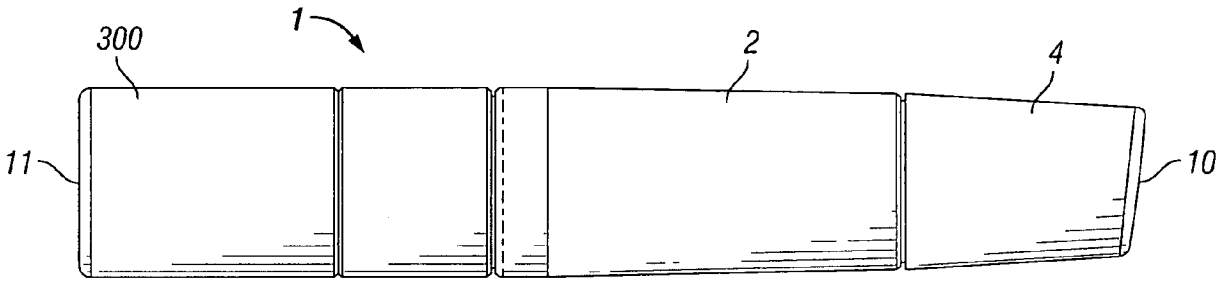
FIG. 4 is a side perspective of the dispenser 1 of FIG. 1 in a closed position.
Figure 5:
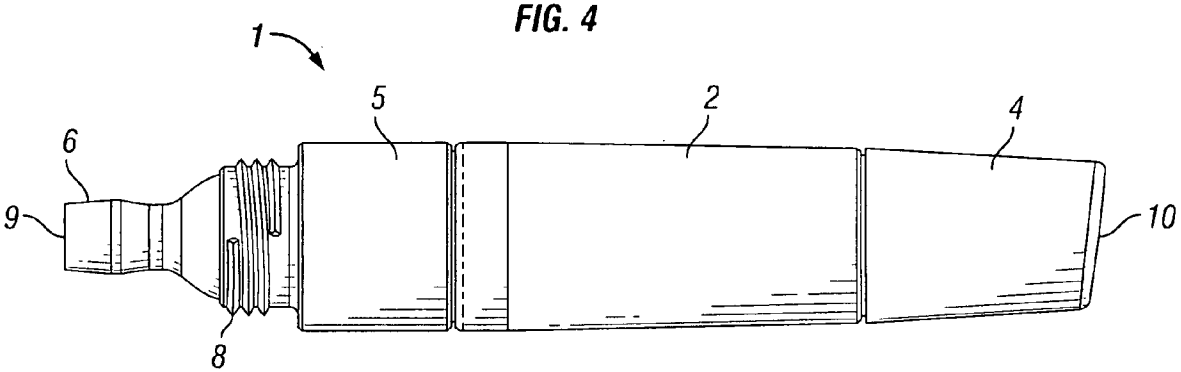
FIG. 5 is a side perspective of the dispenser 1 of FIG. 2 with the cap 300 removed, and with an applicator 7 retracted into the dispenser 1.
Figure 6:
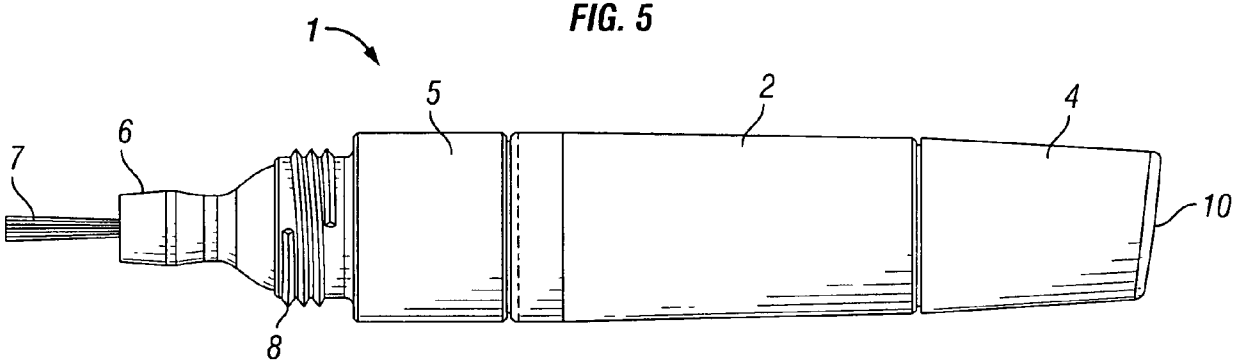
FIG. 6 is a side perspective of the dispenser 1 of FIG. 3, with an applicator 7 distended.

FIGS. 4, 5, and 6 depict side perspectives of the dispenser 1 and show the same relative components in the same relative positions as FIGS. 1 through 3, respectively. Additionally, these figures depict features of the tail cap 4 not readily ascertainable from FIGS. 1 through 3. In the present embodiment, the tail cap 4 is not usually removable at the election of the user. However, alternative embodiments may make use of a tail cap 4 removable at the user's election.

The tail cap 4 serves a variety of functions. First, the tail cap 4 fits around the anterior of the body 2, wherein the outer surface of the body 2 and the outer surface the tail cap 4 smoothly align to give a unified appearance to the tail cap 4 and body 2 assembly. Secondly, the beveled design of the tail cap 4 in the present embodiment of the dispenser 1 prevents the tail cap 4 from being used as a base during storage of the dispenser 1 during periods of non-use. Since the internal components are suitably situated more toward the head 5, storing the dispenser 1 upright with the tail cap 4 used as a base for an extended period of time will result in said internal components withdrawing from the fluid substance stored in the reservoir 2. When said internal components are not submerged in said fluid substance, the fluid substance remaining on said internal components may dry out and harden. Such hardening prevents said internal components from functioning as designed. In the present embodiment, the tail cap 4 has a beveled distal end 10, thus discouraging the storage problem discussed above. Conversely, upright positioning with the cap 300 as the base is encouraged and even facilitated by the design of the flat cap top 11 of the cap 300, especially considering the fact that vertical positioning in this manner is a likely form of merchandising.

It is important to note that although the drying out and solidifying of the fluid stored in the reservoir 2 is a concern, as discussed above, such an occurrence will not result in total failure of the dispenser 1. Dried out internal components may be cured to their functional states by resaturating said internal components with the fluid substance stored in the reservoir 2. This aspect is important, since the dispenser may be stored in a shipping box or display case with the tail cap facing down, for an extended time period. The product would then become usable again once the dispenser was properly positioned for an adequate period of time to allow resaturation of the internal components.

The third function of the tail cap 4 is aesthetic. As discussed further below, the fluid substance stored in the reservoir 2 does not fully occupy the available volume of the reservoir 2 because various internal components occupy the dispenser 1 which require space to function properly. Accordingly, some initial under-fill of the reservoir 2 must be taken into account to prevent overflow of said fluid substance during dispenser 1 assembly. When the dispenser 1 is displayed for sale the potential consumer may be off-put by a reservoir 2 which appears to not be filled to capacity. The appearance of under filling would be particularly exaggerated while in the upright position using the cap 300 as the base. To solve this potential problem, an opaque tail cap 4 may be used to conceal the requisite under-fill level and extend over the reservoir 2 to a suitable extent, thereby further concealing the level of fluid substance stored therein.

Though the present embodiment depicts the tail cap 4 as a separate component of the dispenser 1, applicant also contemplates a tail cap 4 that defines the butt of the reservoir 2. The same features of the tail cap 4 in that alternate embodiment can be accomplished through proper shaping of the reservoir's 2 butt and through paint (or opaque materials). Thus, a separate tail cap 4 is essentially an optional component of the dispenser 1. Accordingly, one alternate embodiment of dispenser 1 would truncate after the reservoir 2. Other alternate embodiments will be readily apparent to those skilled in the art.

The typical use of the dispenser 1 of the present application can be illustrated by FIGS. 1, 2, 3, 4, 5, and 6 in combination. First, the cap 300 is removed from the head 5 of the dispenser 1 of FIGS. 1 and 4, thereby exposing the nose 6 as depicted in FIGS. 2 and 5. In the present embodiment, coupling of the cap 300 and head 5 parts is generally achieved via a "screw" and "nut" mechanism, whereby the head 5 effectively screws into the cap 300 via a head screw 8. Thus, one rotates the cap 300 to unscrew it from the head 5 along the head screw 8. However, a "screw" and "nut" mechanism is not the only means for securing the cap 300 over head 5 and such other appropriate means (for example, snap, squeeze, clip, stick, press, interlock, and the like) will be readily available to one skilled in the art.

Next, with the cap 300 removed, as shown in FIGS. 2 and 5, the applicator 7 may be exposed, as shown in FIGS. 3 and 6, by suspending the dispenser 1 with the tail cap 4 and reservoir 2 raised vertically superior relative to the head 5 and nose 6. It should be kept in mind that complete extension of applicator 7 may also be achieved in any other suspended position wherein the tail cap 4 and reservoir 2 are raised relative to the nose 6 and head 5. Such a position will always result when a user holds the dispenser 1 at the head 5 or reservoir 2. In some limited respects, the method and orientation in which one typically uses the present dispenser 1 may resemble the way in which one typically uses an ink pen, with the pen's ink tip held below the body of the pen.

When a user has completed application of the fluid substance and wishes to retract the applicator 7, the user simply rotates the dispenser 1 by lowering the tail cap 4 relative to the nose 6 and head 5. Stated more simply, a dispenser 1 is toggled by rocking it back and forth causing the applicator 7 to enter and exit the nose 6. The toggling parameters of a dispenser 1, loaded with nail polish, have been compared with the toggling parameters of an empty dispenser 1, wherein the weighted shaft 16 weighs 7.8 grams. The results indicate that if a loaded dispenser 1 is tilted around a central pivot point along the dispenser's 1 length, by 30° relative to a horizontal position, the applicator 7 extends from, or retracts within, the nose 6 depending on whether the head 5 or tail cap 4 is below the horizontal; if the head 5 is lower, the applicator 7 extends, if the tail cap 4 is below, the applicator 7 retracts. In contrast to a loaded dispenser 1, an empty dispenser 1 toggles with a 15° tilt relative to the horizontal. Of course, the toggling angles change with the viscosity of the loaded substance, and weight of the weighted shaft 16. For example, a dispenser 1 filled with water, toggles at similar angles to those mentioned above when the weighted shaft 16 weighs 0.4 grams.

An important utility of the dispenser 1 lies in the above-mentioned toggling action, alternating between open (FIGS. 2 and 5) and delivery (FIGS. 3 and 6) configurations. Referring to FIGS. 2 through 6, a non-exclusive method of toggling suitably consists of a user holding a dispenser 1 in an open configuration by griping it approximately equidistant between the head 5 and tail cap 4 on the reservoir 2 and thereafter completing the following steps in order: (1) raising the head above the user's grip while simultaneously lowering the tail cap 4 below the user's grip (thereby causing retraction of applicator 7 into the reservoir 2); (2) returning the dispenser 1 to the initial position; and, finally (3) raising the tail cap 4 above the user's grip while simultaneously lowering the head 5 below the user's grip (thereby causing extension of applicator 7 from the avenue 9 at the nose 6). Subject thereto, toggling occurs whenever an applicator 7 transitions from an extended position to a retracted position and back (and/or vice versa). Fluid substance stored in the reservoir 2 will collect upon the applicator 7 during toggling between open and delivery configurations. After sufficient toggling, when a desired amount of fluid substance is accumulated on the applicator 7, the user utilizes the extended applicator 7 to apply the fluid substance to the desired target. It should be noted that when attached to the dispenser 1 the cap 300 prevents toggling, since the applicator 7 is blocked from exiting the dispenser 1 through the avenue 9 at the nose 6.

Figure 7A:
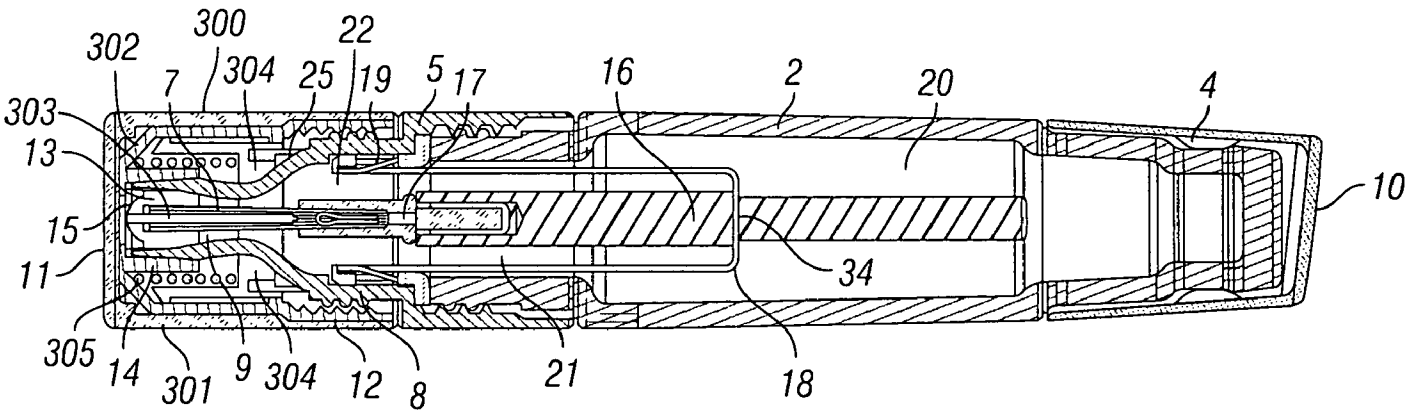
FIG. 7A is a longitudinal cross-section of the dispenser 1 of FIGS. 1 and 4 in a closed position.
Figure 7B:
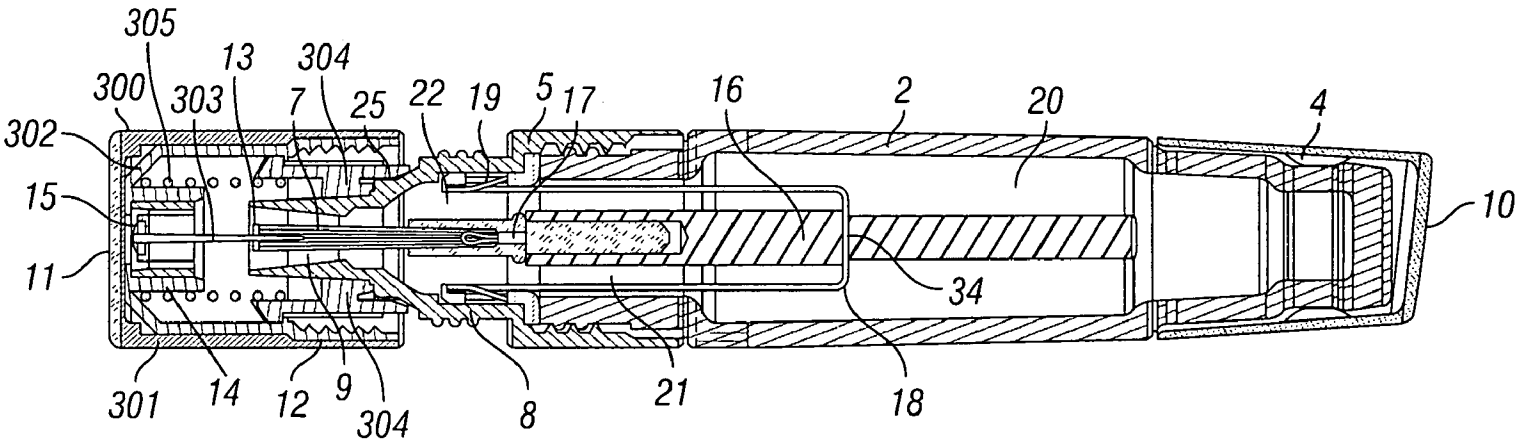
FIG. 7B is a longitudinal cross-section of the dispenser of FIG. 7A depicted in a partially open state.

FIGS. 7A and 7B are longitudinal cross-sections of the dispenser 1 of FIG. 4 which illustrates the above-mentioned internal components of the dispenser 1. The only difference between FIGS. 7A and 7B is that the cap 300 is partially disengaged in FIG. 7B. The internal components of the dispenser 1 depicted in these figures are generally as follows: the applicator 7; the applicator assembly 17; the weighted shaft 16; the shaft guide 18; and, the shaft guide base 19.

More particularly, FIGS. 7A and 7B illustrate the internal components of the cap 300. The cap 300 is typically an assembly of the shell 301, the hood 302, the spreader 303, the nose guide 304, and the spring 305. As mentioned above, the cap 300 is removably fastened to the nose 6 by complementary coupling parts featured on the inside of the cap 300 and on the outside of the nose 6. In the present embodiment, the head screw 8 rotatably inserts into the cap nut 12 to achieve cap 300 attachment. Reversing the aforementioned action results in cap 300 removal.

It should be noted that, as depicted in FIGS. 7A and 7B, the cap 300 serves several purposes. First, the cap 300, when secured over the nose 6, prevents leakage of the fluid substances stored in the reservoir 2. As depicted clearly in FIGS. 7A and 7B, the cap 300 features a hood 302 with a receiver 14 that femininely accepts the nose 6, thereby forming a seal around the avenue 9. The aforementioned seal is formed via constriction of the receiver 14 around the nose 6. The nose 6 is able to insert into the receiver 14 since the nose 6 tip has a relatively smaller diameter than the receiver 14. However, the nose 6 tapers to a relatively larger diameter than the receiver 14, thereby causing the receiver 14 to expand elastically, and then constrict around the nose 6. It is this constrictive force which forms said seal and prevents the fluid substance stored in the reservoir 2 from leaking out of the avenue 9 when the cap is attached.

Second, and as mentioned above, the cap 300 prevents toggling when attached. In the present embodiment, as displayed in FIGS. 7A and 10, the cap 300 prevents toggling of the dispenser 1 because the stopper 15, which fits inside the receiver 14 when the dispenser 1 is in a closed configuration, blocks the avenue 9 to stop the applicator 7 from exiting the nose 6. Additionally, the present embodiment of the stopper 15 aids in preventing leakages of the fluid substance stored in the reservoir 2 by essentially plugging the avenue 9.

Third, the cap 300 prevents the drying-out of the applicator 7. As depicted in FIGS. 7A and 7B, the cap 300 combats dry-out with the spreader 303, which (1) props up the weighted shaft 16 (as discussed further below in connection with shut-off 26, shown in FIG. 9) and (2) spreads the applicator 7 whereby more surface area is available for substance collection. These mechanisms combat dry-out because a propped weighted shaft 16 allows the contained fluid to enter the avenue 9, and spreading the applicator 7 facilitates saturation of the applicator 7. Furthermore, the spreader 303 serves a function of reducing deformation of the applicator 7, particularly where applicator 7 is a brush.

As depicted in FIGS. 7A and 7B, the spreader 303 ideally passes through the avenue 9 unobstructedly to engage the applicator 7 during cap 300 placement. In other words, the spreader 303 and the avenue 9 should typically maintain an approximately coaxial relationship during the engagement of the cap 300 over the nose 6. This approximately coaxial relationship is ensured by a nose guide 304 movably situated within the hood 301 of the cap 300. The nose guide 304 is defaultly positioned at the opening of the cap 300 (as seen in FIG. 7B) by the spring 305, and will not engage the nose 6 without coaxial interaction. Thus engaged, the nose guide 304 unobstructedly delivers the avenue 9 to the spreader 303 during cap 300 placement (as seen in FIG. 7A) over the head screw 8.

The nose guide 304 also preserves the coaxial relationship of the spreader 303 and the avenue 9 during cap 300 removal. Upon disengagement of the cap 300 from head screw 8 (i.e., the transition from FIG. 7A to 7B), the spring 305 expands to force the nose guide 304 to its default location. The nose guide ensures the coaxial relationship of the spreader 303 and avenue 9 until the nose guide 304 and the nose 6 are disengaged at the cap 300 opening.

Figure 8:
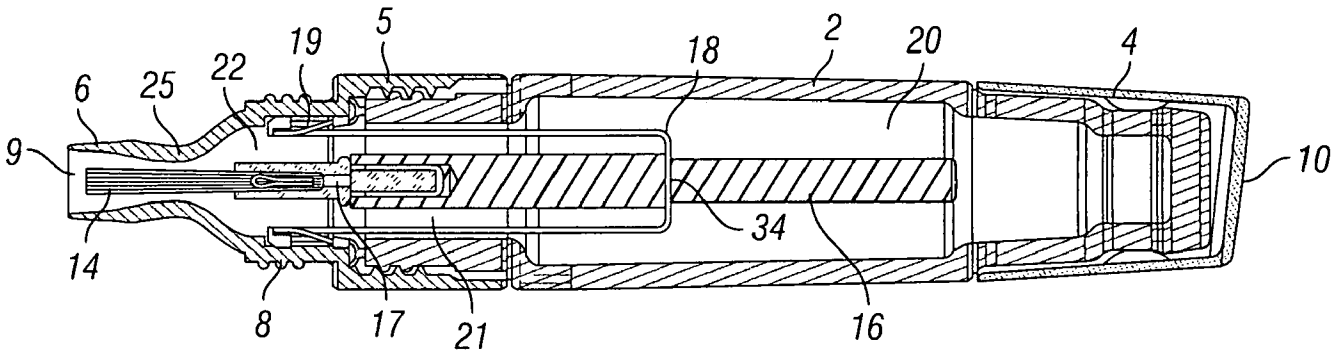
FIG. 8 is a longitudinal cross-section of the dispenser 1 of FIG. 5 with cap 300 removed and with applicator 7 distended.
Figure 9:
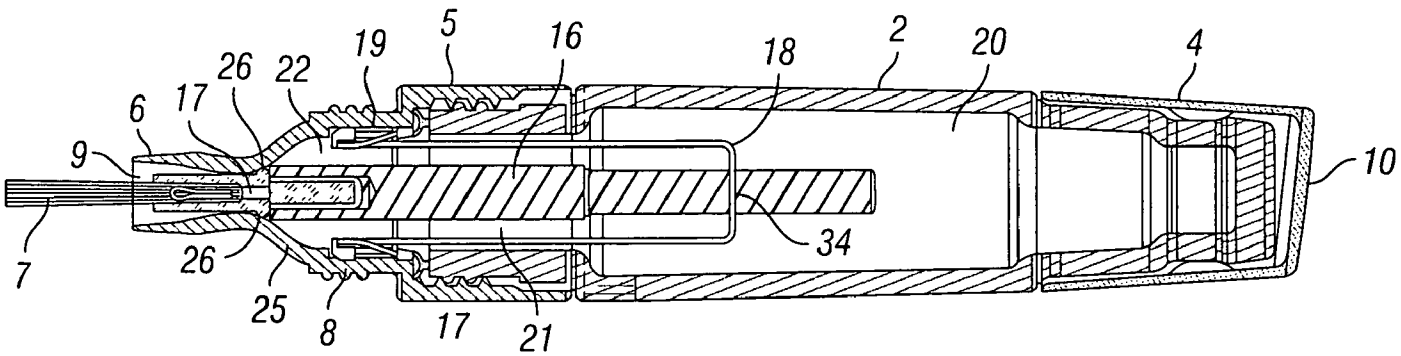
FIG. 9 is a longitudinal cross-section of the dispenser 1 of FIG. 6 with cap 300 removed and with applicator 7 extended.

FIG. 8 is a longitudinal cross-section of the dispenser 1 depicted in FIGS. 2 and 5 with the cap 300 removed and the internal components of the dispenser 1 in the same relative positions as depicted in FIGS. 7A and 7B. Note that the applicator 7 remains retracted into the nose 6 in this FIG. 8. FIG. 9 is a longitudinal cross-section of the dispenser as depicted in FIGS. 3 and 6 with the cap 300 removed and the applicator 7 extended through the nose 6. FIG. 9 also displays the weighted shaft 16 shifted into a position toward the head 5. Together, FIGS. 8 and 9 provide a more detailed illustration of the functions and positions of the internal components during toggling, as described immediately below.

Beginning with FIG. 9, a dispenser 1 in a closed configuration is usually held downward, with the tail cap 4 in the air. As the user tilts the nose 6 up relative to the tail cap 4, the weighted shaft 16 travels along the shaft guide 18 and displaces fluid substance and/or air (depending on how much of the fluid product has been used up) contained in the reservoir cavity 20 forcing fluid present in cavity 22 due to surface tension into avenue 9 collecting on applicator 7. In FIG. 8, a dispenser 1 in an open configuration is usually held upright, with the nose 6 in the air. As the user tilts the nose 6 down relative to the tail cap 4, the fluid substance stored in the dispenser 1 begins to flow from the reservoir cavity 20 toward the head cavity 22. Meanwhile, the weighted shaft 16 travels along the shaft guide 18 and begins to push applicator assembly 17 and applicator 7 through avenue 9. Simultaneously, the forward movement of the weighted shaft 16 creates a void in cavity 20 which results in a vacuum in reservoir cavity 20 which has the effect of drawing fluid from avenue 9, through cavity 22, and back into the reservoir cavity 20.

Once the user has rocked the dispenser forward sufficient to extend the applicator 7 from the nose 6, the weight of the weighted shaft 16 presses the applicator assembly 17 against the nose cone 25, thereby creating a shut-off 26. This shut-off 26 prevents the fluid substance from further passing into the avenue 9, and also holds said fluid substance in the head cavity 22. The fluid substance in the avenue 9 is then collected by the applicator 7 upon the applicator's 7 return to the reservoir cavity 20 after the dispenser 1 is rocked back and the fluid substance and the internal components are shifted back into the reservoir cavity 20. Thus, a single toggle (in-and-out) of the dispenser 1 is sufficient to collect a measure of fluid substance on the applicator 7 for delivery to a target. Moreover, additional accumulation of fluid substance on the applicator 7 may be accomplished by repeated toggling of the dispenser 1 if a heavier dose of substance is desired by the user.

The design of the applicator 7 should be considered in light of the tendency of the fluid substance stored in the dispenser 1 to dry out. The applicator 7 should be relatively flexible and ductile so that, when it is used for application purposes, it does not displace the shut-off 26, thus resulting in unwanted leakage of fluid substance. Accordingly, the applicator 7 of the present embodiment is depicted as a brush (or grouping of hair strands). Hypothetically, a danger exists, when the dispenser 1 has an inflexible applicator 7 (whether due to poor design or dry-out) and a user attempts to apply the fluid substance collected on the applicator 7 by pressing the applicator 7 on a target, that the stiffness of the applicator 7 would transfer the force of the delivery to the weighted shaft 16 thereby displacing the shutoff 26. Such an action may allow the fluid substance to leak through the avenue 9 in an unregulated fashion.

Depending on its intended use, alternative embodiments of the dispenser 1 may require components of differing sizes or shapes. For instance, the physical traits of the nose 6, weighted shaft 16 and the applicator assembly 17 help determine the amount of fluid substance that is dispensed with each toggle. Also, the physical properties of the fluid substance stored in the dispenser may determine the dimensions and traits of components in alternative embodiments. For example, a greater surface tension between the internal surface of the avenue 9 and the fluid substance stored in the dispenser 1 helps eliminate fluid drip from the nose 6 when the shut-off 26 is closed. Additionally, a higher surface tension between the nose cone 25 and the fluid substance assists in metering the amount of fluid substance that enters the avenue 9 while the shut-off 26 is open. In addition to surface tension considerations, the geometry of the nose 6 (including the avenue 9 diameter and the nose cone 25 angle) also contributes to the efficient metering of the fluid substance into the avenue 9 and the amount of fluid substance collected on the applicator 7 with each toggle. Accordingly, decisions as to the roughness of the surfaces, the type of materials employed, and fluid stored in the dispenser will be readily apparent to one skilled in the art.

Other design choices may be made in alternate embodiments as well. For instance, design aspects of the weighted shaft 16 and applicator assembly 17 and shaft guide 18 play important roles in the metering of fluid substance through the avenue 9. When the weighted shaft 16 is moved back into the reservoir cavity 20, the fluid substance and/or air in reservoir cavity 20 gets displaced. This displacement causes the fluid substance present in cavity 22 into avenue 9. The amount of displaced fluid and/or air in reservoir cavity 20 is determined by a combination of the stroke length of the weighted shaft 16 as it toggles from the extended to retracted position, as well as the diameter of the weighted shaft 16 which defines the volume displacement per unit of travel of the weighted shaft 16. The geometry of cavity 22 working in conjunction with the fluid viscosity determines how fluid is retained in cavity 22. These design elements working in concert determine the amount of fluid that can flow into avenue 9 without overflowing. If the area of cavity 22 and avenue 9 is too small to accommodate the fluid displaced when the weighted shaft 16 is retracted, the displaced fluid substance will over flow out of avenue 9 after toggling the applicator assembly back into avenue 9. If the area of cavity 22 and avenue 9 is too large, the displaced fluid substance will not flow into avenue 9 and properly saturate the applicator after toggling the applicator assembly back into avenue 9. Therefore, the stroke length of the weighted shaft 16 and the geometry of the area of cavity 22 and avenue 9 are factors in determining the amount of fluid pumped into avenue 9.

To function correctly, the dispenser 1 depends on the shut-off 26 to close properly once a sufficient amount of substance has been pumped into the avenue 9. In most instances, the user will want to have almost immediate recovery when the weighted shaft 16 is rocked backward and then forward during toggling. In addition to the weighted shaft 16 dimension considerations mentioned above, the size and weight of the weighted shaft 16 affects the speed at which the weighted shaft 16 moves through the fluid substance itself. Thus, if the weight is too low as compared to the viscosity of the fluid substance, the weighted shaft 16, and thus the applicator 7 too, will move back and forth through the fluid substance very slowly. For example, nail polish has a low viscosity and the weighted shaft 16 should be relatively heavy. Accordingly, a person skilled in the art would adjust the weight of the weighted shaft 16 according to the viscosity of the fluid substance stored in the dispenser 1.

FIGS. 8 and 9 also illustrate the importance of the shaft guide 18, which guides the weighted shaft 16 during toggling and limits the extent to which the applicator 7 may enter the dispenser 1 during toggling. The entry of the weighted shaft 16 into the dispenser 1 is so limited because the weighted shaft 16 is composed of two cylindrical segments of differing diameters. The rear of the shaft guide 18 suitably features an aperture 34 which is operationally configured to receive the cylindrical segment of the weighted shaft 16 with the smaller diameter, but not the segment with the larger diameter. Accordingly, when a user toggles the dispenser 1 to retract the applicator 7, said applicator 7 enters the nose 6. At the same time, the applicator assembly 17, and the weighted shaft 16 move relative to the shaft guide 18 through the aperture 34, until the junction of the smaller and larger diametered segments of the weighted shaft 16 meet the aperture 34. At that point, the segment of the weighted shaft 16 with the smaller diameter will have been received through the aperture 34, while the larger diametered segment of the weighted shaft 16 will not be allowed to pass through the aperture 34. The present embodiment of the dispenser 1 is suitably configured such that the weighted shaft 16 is sized so that the applicator 7 passes no further into the dispenser than the avenue 9 (as depicted by FIG. 8). If the weighted shaft 16 is improperly proportioned, unsmooth toggling may result, since the applicator 7 would need to reenter the avenue 9 with each and every toggle. However, alternate embodiments may be contemplated where the applicator 7 retracts completely into the reservoir cavity 20 or, conversely, completely exits the avenue 9 during toggling.

Figure 10:
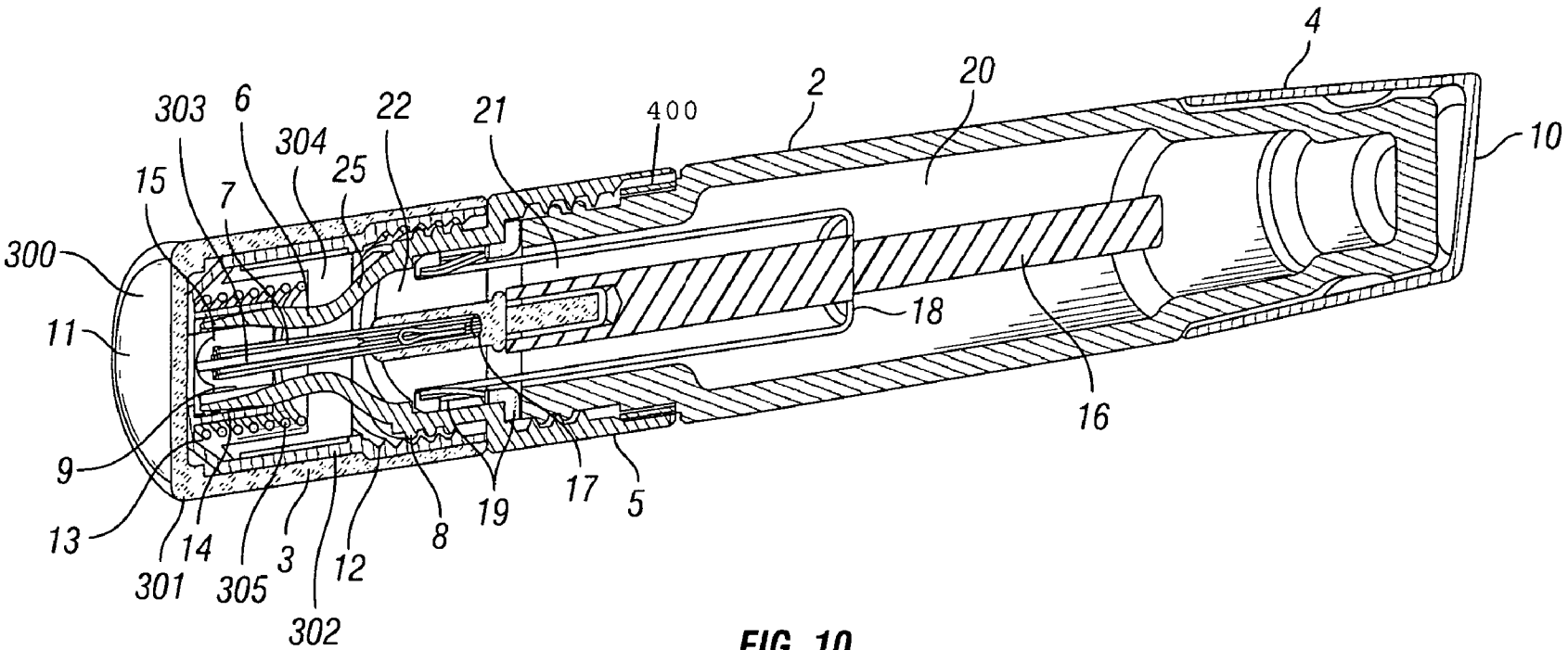
FIG. 10 is a three-dimensional longitudinal cross-section of the dispenser 1 of FIGS. 1, 4 and 7A.

FIG. 10 is a three-dimensional longitudinal cross section of the dispenser 1 of FIGS. 1, 4, 7A, and 7B. In this configuration, the cap 300 is secured over the head 5 with the internal engagements depicted as previously discussed in connection with FIG. 7A. Note that the shut-off 26, as described above, remains un-established. Though a closed shut-off 26 prevents fluid substance leakage during applicator 7 use, an open shut-off 26 is equally important during storage and when the cap 300 is affixed. When in such a configuration, stored fluid substance may freely enter and exit the avenue 9, thereby saturating the applicator 7 during fluid substance collection. Were the shut-off 26 able to close, the applicator 7 would be effectively isolated from the contained substance. Due to the high evaporation rates of cosmetic lacquers typically used, the fluid substance remaining on the applicator 7 could dry out, resulting in a stiff applicator 7 and the problems detailed above. Accordingly, the applicator 7 is usually rigid enough to withstand the weight of the weighted shaft 16, thereby preventing the shut-off 26 from being established. As discussed above, if an applicator 7 is not stiff enough to prop the weighted shaft 16, then the spreader 303 will do so to ensure that the shut-off 26 is not established. The applicator 7 of the present embodiment is a brush that is typically found in all current cosmetic lacquer dispensers, and without a spreader, the bristles will twist and deform over time under the weight of the weighted shaft 16. However, material with the necessary rigidity required to support an open shut-off 26, with or without the spreader 303, while the cap 300 is fastened to the dispenser 1, yet enough flexibility to permit a closed shut-off 26 during use, will be readily apparent to one skilled in the art.

Figure 11:
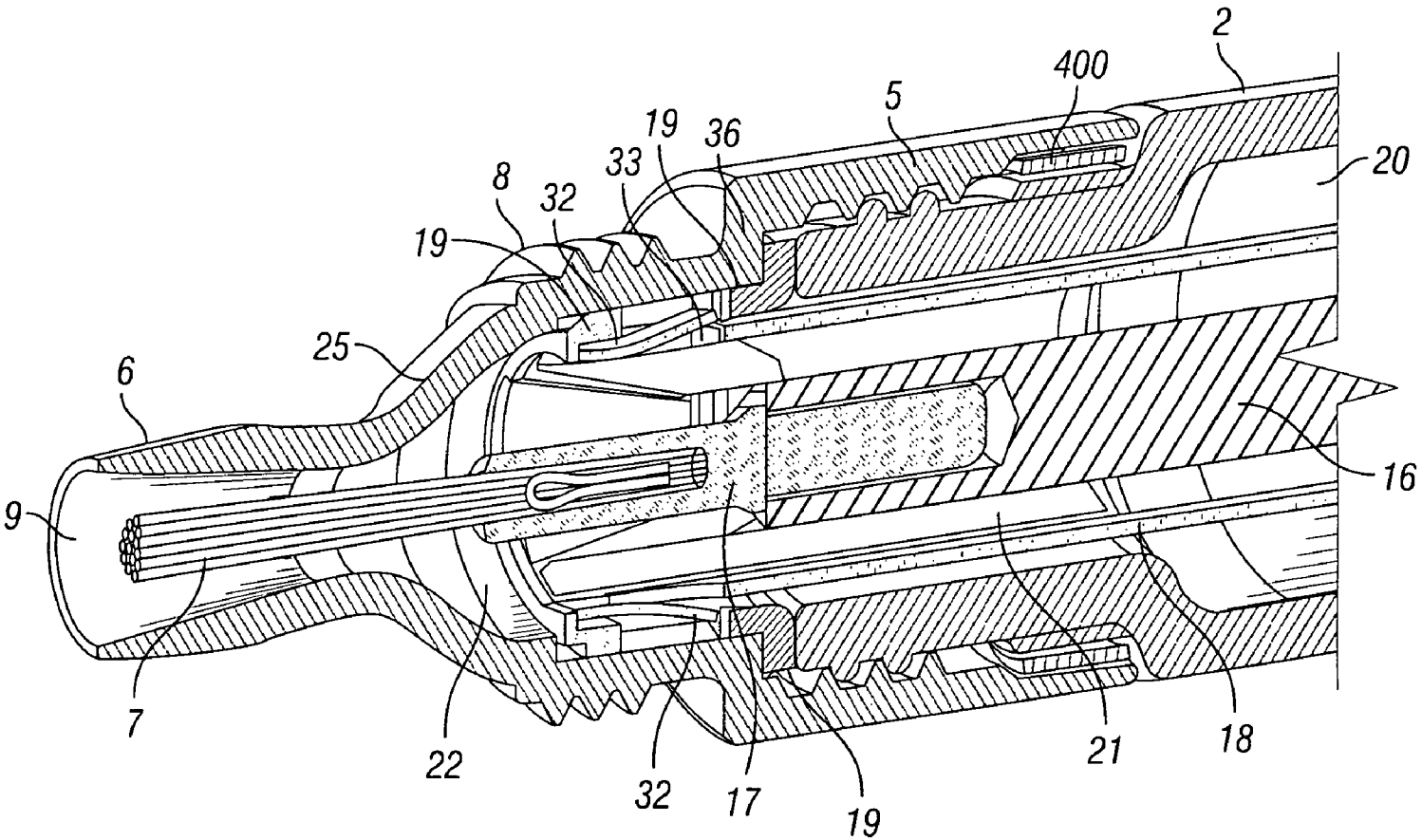
FIG. 11 is a three-dimensional rendering of a head 5 portion of a dispenser 1.
Figure 12:
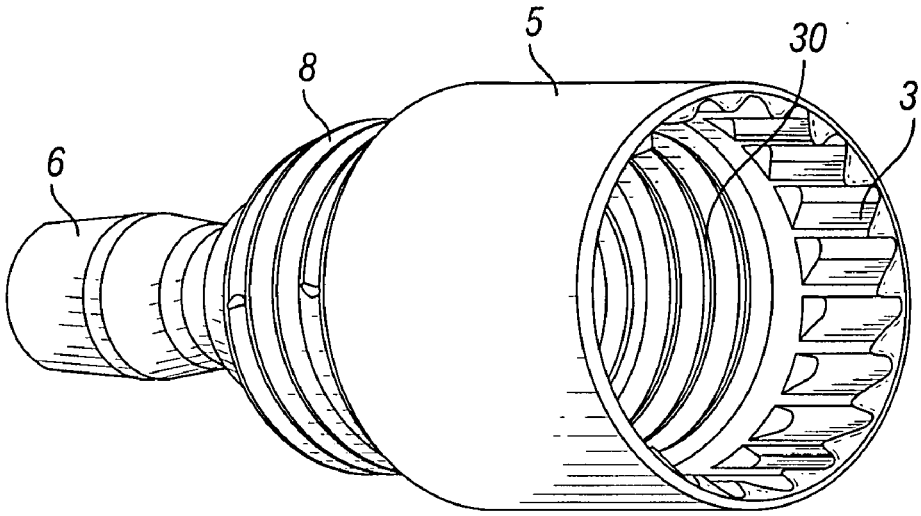
FIG. 12 is a three-dimensional aft-perspective of the head 5 disassociated from the dispenser 1, and displaying the nut threads 30 and teeth 31, therein.
Figure 13:
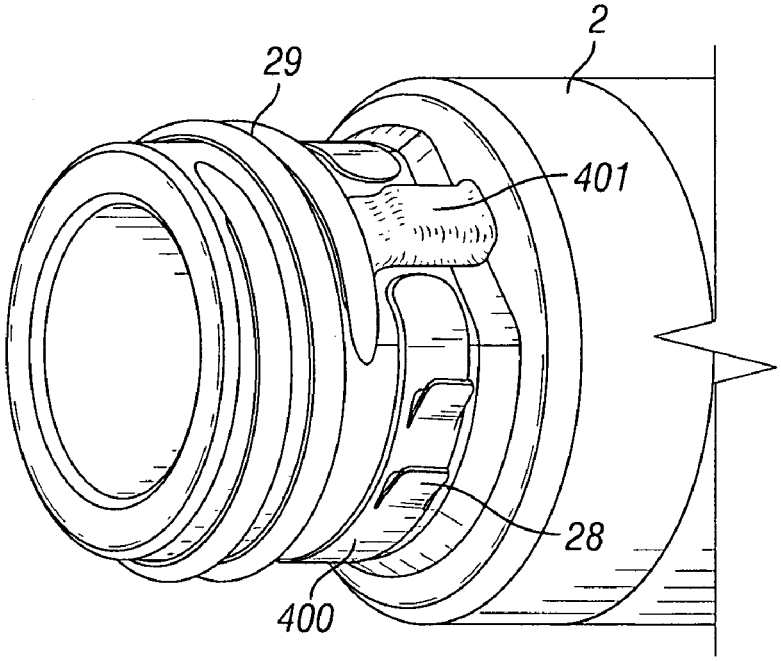
FIG. 13 is a three-dimensional rendering of an appendage of the reservoir 2, displaying the locking lugs 28 and screw threads 29, among other components.

FIG. 11 is a "zoomed in" cross-sectional view of a fully connect head 5 and reservoir 2. FIGS. 12 and 13 are three-dimensional perspectives of the receiving end of the head 5 and the male end of the reservoir 2 respectively. FIGS. 11 through 13 illustrate the elements utilized in making a connection between the head 5 and the reservoir 2 which forms the channel 21. First, as shown in FIG. 11, the applicator assembly 17, coupled with the weighted shaft 16, are inserted through the head 5 with the applicator 7 extended through the nose 6. Next, the shaft guide 18 is connected to the guide base 19 via extension of arms 32 into nooks 33. Then the guide base 19 and shaft guide 18 assembly are masculinely inserted into the receiving end of the head 5. Consequently, the smaller diameter segment of the weighted shaft 16 continues to extend through the aperture 34 in the rear of the shaft guide 18.

Prior to the coupling of the head 5 assembly (including the shaft guide 18 extending from mouth of the head 5) with the reservoir 2, as illustrated in FIG. 11, the lug ring 400 is placed around the outside portion of the reservoir 2, whereby locking lugs 28 extend somewhat radially as depicted in FIG. 13. The ring 400 is non-rotably fixed to the reservoir at said location by associating the ring 400 with the ring stop 401 as depicted in FIG. 13. Then the weighted shaft 16 and shaft guide 18 are masculinely inserted into the reservoir 2 at the open end of the reservoir 2, thereby forming a coaxial merge with the head assembly and the reservoir 2 as depicted in FIG. 11. The screw threads 29 of the reservoir 2 are then masculinely inserted into the head 5 and rotated in conjunction with the nut threads 30 to produce coupling. The locking lugs 28 on the ring 400 finally interact with the teeth 31 to prevent rotation in the opposite direction, effectively preventing uncoupling of the head 5 and reservoir 2. Though the locking lugs 28 and the teeth 31 are depicted in the FIGS. 12 and 13, various other methods and components known to those skilled in the art may alternatively be employed to accomplish relatively permanent coupling of the head 5 and reservoir 2, such as a snap on head 5 with a key built into the reservoir 2.

As illustrated in FIGS. 12 and 13, the locking lugs 28, teeth 31, ring 400, and ring stop 401 function to prevent unwanted head 2 removal when the cap 300 is being unscrewed and removed. Without said locking lugs 28, or similarly functioning mechanism, rotating the cap 300 relative to the dispenser 1 to remove the cap 300 may result in disassociation of the head 5 from the reservoir 2 and, consequently, spillage of the fluid substance contained therein. Other mechanisms may be utilized for the same function and would be readily apparent to a person skilled in the art.

Figure 14:
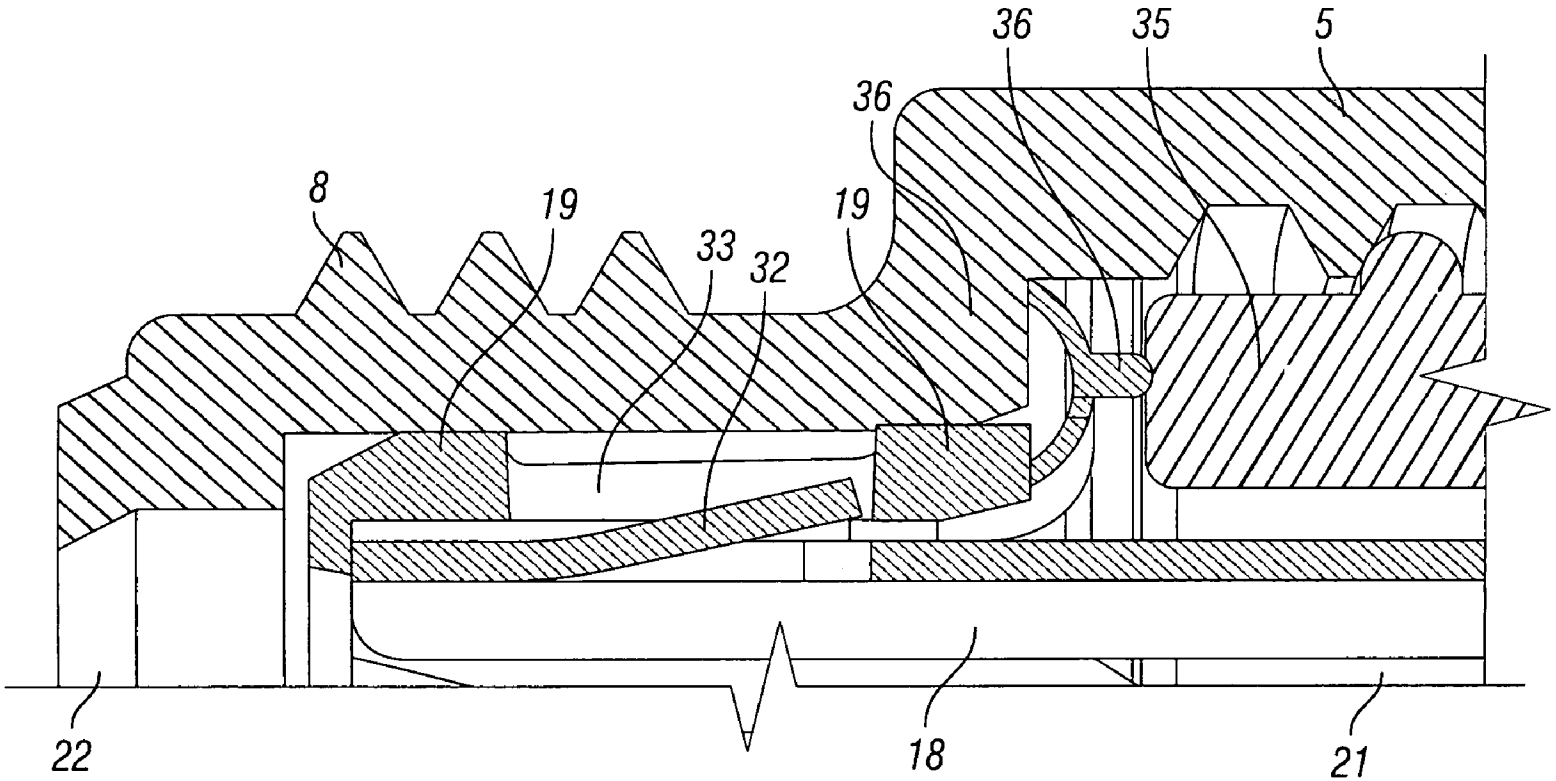
FIG. 14 is a "zoomed in" cross-section of the upper portion of the head 5.

FIG. 11 is a three-dimensional illustration of the interface between the head 5 and the reservoir 2. FIG. 14 is a "zoomed in" cross-section of FIG. 11. Together, FIGS. 11 and 14 depict the utility of the guide base 19. Not only does the guide base 19 secure the shaft guide 18 in place via the shaft guide arms 32 which extend through the nooks 33 in the guide base 19, but the guide base 19 also seals the interface of the head 5 and the reservoir 2, and thus also seals the channel 21. In FIG. 14, the lower portion of the guide base 19 is positioned between the reservoir tip 35 and the inner ledge 36 of the head 5. Also, FIG. 14 depicts how the deformation of the guide base 19 between the reservoir tip 35 and the inner ledge 36 seals the interface of the reservoir 2 and the head 5. Accordingly, the fluid substance stored in the reservoir 2 may not escape the dispenser 1 while stored therein, or while moving through the channel 21 between the reservoir cavity 20 and the head cavity 22.

Figure 15:
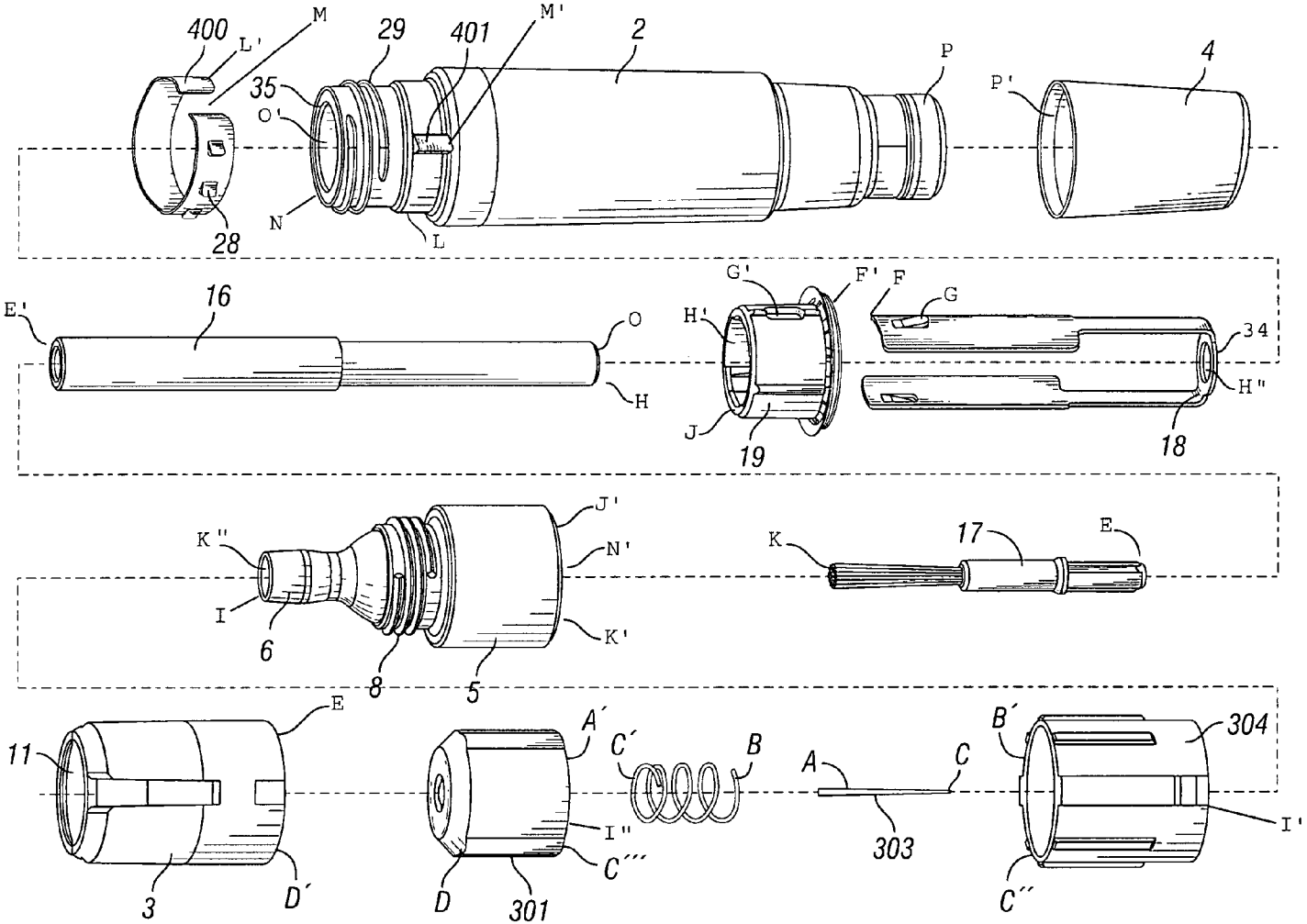
FIG. 15 is a disassembled view of the components of a dispenser 1 which generally depicts the dispenser 1 assembly along the dashed line.

FIG. 15 represents an inventory of components necessary for dispenser 1 assembly. FIG. 15 also represents a disassembled view of the dispenser 1 of the present application, which may generally be assembled along the dashed line beginning with the cap top 11 in the lower left of figure, continuing to the tail cap 4 in the upper right (when viewed horizontally). More specifically, the dispenser 1 may be assembled as follows. First, the cap 300 guiding system is assembled as follows: attaching the spreader 303 at the base of the hood 302 (A to A'); putting spring 305 into the nose guide 304 (B to B'); inserting the spring 305 and nose guide 304, while the spreader 303 inserts into the spring 305 and possibly the nose guide 304 (C to C', C' to C''', C'' to C'''); and then, the hood 302 is positioned inside the shell 301 (D to D'). Though the shell 301 and the hood 302 of the present embodiment are pictured as separate components, in an alternate embodiment the hood 302 and the cap 300 could be fabricated as a single unit.

Next, the applicator assembly 17 is attached to the weighted shaft 16. In the present embodiment, the end of the applicator assembly 17 without the applicator 7 is femininely received by the weighted shaft 16 (E to E'), although in an alternate embodiment, the applicator assembly 17 and the weighted shaft 16 could be fabricated as a single unit. Then, the shaft guide 18 is connected to the guide base 19 via sliding the shaft guide 18 through the guide base 19 (F to F') and extending of the arms 32 into nooks 33 (G to G'). In this particular embodiment, the guide base 19 and shaft guide 18 are fabricated as separate components, although in alternate embodiments, these components could be fabricated as a single unit. Now, the segment of the weighted shaft 16 with the smaller diameter, followed by the rest of the weighted shaft 16 and then the applicator assembly 17 are inserted into the opening (H') of the guide base 19. The smaller diameter segment of the weighted shaft 16 continues through the aperture 34 in the rear of the shaft guide 18 (H to H' to H'').

At this point, the weighted shaft 16 should extend through the aperture 34 (H'') at the rear of the shaft guide 18, with the applicator 7 extending from the opening (H') of the guide base 19. Next, the head 5 may be rotatably inserted into the cap 300 by placing the nose 6 into the nose guide 304, and then the rest of the head into the hood 302 (I to I' to I''). Then, the guide base 19 is inserted into the rear of the head 5 (J to J') while the applicator 7 is simultaneously passed into the rear of the head 5 and up into the avenue 9 of the nose 6 (K to K' to K''). Next, the ring 400 is placed around the reservoir (L to L') whereby the ring is associated with ring stop 401 (M to M').

At this point the reservoir cavity may be filled with the fluid substance to be stored in the dispenser 1. After said substance has been loaded into the reservoir cavity 20 (with the requisite under-fill mentioned above), all the heretofore combined components (as a separate sub-assembly), are inserted together into the reservoir cavity 20. To do so, the extended portion of the weighted shaft 16 (O to O') is inserted into the reservoir cavity, until the reservoir tip 35 rotatably enters the rear of the head 5 (N to N'). This allows the nut 30 and the screw 29 threads to interact until the locking lugs 28 have locked the head in place via the teeth 31 as described above in connection with FIGS. 11 through 14. Inserting the separate sub-assembly into the reservoir cavity 20 after it has been loaded with contained substance allows for manufacturing ease and for a filling process that is very similar to current cosmetic lacquer dispensers. Finally, the tail cap 4 is placed over the distal end of the reservoir 2 (P to P'). Other assembly methods may be practiced depending on the use of alternative embodiments described herein, and will be readily apparent to those skilled in the art.

We claim:

1. A hand-held cosmetic lacquer dispenser comprising:
a body, capable of containing at least one lacquer;
an applicator, togglable between an internal or external locations relative to said body, and operationally configured to accumulate a portion of said contained lacquer when toggled to said internal location, and operationally configured to deliver said accumulated lacquer when external to said body and contacted with a target;
a cap featuring
(A) a flat surface and
(B) a spreader that is
(1) defined by an axial shaft with respect to the cap and
(2) configured to
(a) engage said applicator and
(b) prop a weighted shaft when the dispenser is upstanding on said flat surface
wherein said toggling is accomplished via shifting said body forward to extend said applicator from said body, and shifting said applicator backwards to retract said applicator;
wherein said toggling applicator is a brush; and,
wherein said cap further features a means for guided engagement of said spreader and said applicator.

2. A hand-held cosmetic lacquer dispenser comprising:
a body configured for containing lacquer;
an applicator, electively togglable between more than one location, and configured to deliver said lacquer to a target;
a removable cap featuring
(A) a flat surface and
(B) a spreader that is
(1) defined by an axial shaft with respect to the cap and
(2) configured to
(a) engage said applicator and
(b) prop a weighted shaft when the dispenser is upstanding on said flat surface
a lacquer regulating means whereby said contained lacquer is regulated to minimize the escape of said lacquer from said body during said toggling of said applicator, while said applicator is extended external to said body;
wherein said lacquer regulating means is a weighted shaft that presses against at least one internal wall within said dispenser; and,
wherein said cap features a means for guided engagement of said spreader and said applicator.

3. The dispenser of claim 2 wherein said applicator is a brush.

4. The dispenser of claim 2 wherein said means for guided engagement features a spring and nose guide.

* * * * *